US005242152A

United States Patent [19]

Schatz

[11] Patent Number: 5,242,152

[45] Date of Patent: Sep. 7, 1993

[54] POST PULLER

[76] Inventor: Lester R. Schatz, Box 57, Glen Ullin, N. Dak. 58631

[21] Appl. No.: 27,807

[22] Filed: Mar. 8, 1993

[51] Int. Cl.[5] ..... E21B 19/00

[52] U.S. Cl. ..... 254/30

[58] Field of Search ..... 254/29 R, 30, 31, 132, 254/124

[56] References Cited

U.S. PATENT DOCUMENTS

| | | | |
|---|---|---|---|
| 3,807,695 | 4/1974 | Gremillion et al. | 254/29 R |
| 4,226,402 | 10/1980 | Muth . | |
| 4,256,286 | 3/1981 | Hudgins . | |
| 4,371,018 | 2/1983 | Arnold . | |
| 4,542,880 | 9/1985 | Bishop | 254/29 R |
| 4,706,935 | 11/1987 | Thompson | 254/30 |

*Primary Examiner*—Robert C. Watson

*Attorney, Agent, or Firm*—Zarley, McKee, Thomte, Voorhees & Sease

[57] ABSTRACT

A post puller for use with a tractor loader having a loader bucket pivotally mounted thereon and a grapple fork pivotally mounted on the loader bucket comprising a post receiver mounted on the bucket and a clamping arm operatively secured to the grapple fork so that the post to be pulled may be clamped between the post receiver and the post clamping arm. Upward movement of the loader bucket by the tractor loader causes the post to be pulled from the ground. The post puller is adapted to accommodate wood posts of various diameters as well as steel posts.

14 Claims, 5 Drawing Sheets

POST PULLER

BACKGROUND OF THE INVENTION

1. Field of the Invention

This invention relates to a post puller and more particularly to a post puller which is mounted on a materials handling attachment positioned on the forward end of a tractor loader.

2. Background Art

Many types of post pullers have been previously provided for pulling posts from the ground whether those posts be of the wooden type or of the steel type. Some of the post pullers have been mounted on the vertically movable 3-point hitches of tractors. For example, U.S. Pat. Nos. 4,226,402 and 4,256,286 disclose such devices. Although the devices of U.S. Pat. Nos. 4,226,402 and 4,256,286 may work satisfactorily, it is believed that devices of this type are not convenient to use since they require that the tractor be backed into position, relative to the post to be pulled, which necessarily requires that the tractor operator turn around in his seat to observe the operation. Further, when the post pulling device is mounted on the 3-point hitch of the tractor, the tractor hitch may not be used for any other purpose.

Other types of post pulling devices have been described which are specifically designed as a single-use vehicle. For example, see U.S. Pat. No. 4,371,018 which discloses such a device. The device of the '018 patent is obviously quite expensive and is not an add-on device.

SUMMARY OF THE INVENTION

A post puller is described which is mounted on the bucket of a tractor loader as a piece of "add-on" equipment. When the post puller of this invention is mounted on the tractor loader, the tractor loader may be used in its conventional fashion without any interference from the post puller. The post puller comprises a V-shaped jaw means which is secured to one side of the loader bucket and which is adapted to receive either a wood post or a steel post therebetween. A clamping arm is operatively pivotally secured to a grapple fork mounted on the loader bucket of the tractor loader and has a lower end which is adapted to force or clamp the post into the jaw means. When the post is clamped into the jaw means by the lower end of the clamping arm, the loader bucket is moved vertically upwardly which causes the post to be pulled from the ground.

It is therefore a principal object of the invention to provide an improved post puller.

Another object of the invention is to provide a post puller which may be mounted on a tractor loader and which does not interfere with the normal operation of the tractor loader.

A further object of the invention is to provide a post puller which is an add-on piece of equipment to a conventional tractor loader.

Still another object of the invention is to provide a post puller which may be mounted on a bucket of a tractor loader to enable the tractor operator to pull posts without leaving the tractor.

Still another object of the invention is to provide a post puller which is adapted to accommodate posts of different configurations and sizes.

Still another object of the invention is to provide a post puller which is economical of manufacture and durable in use.

These and other objects of the present invention will be apparent to those skilled in the art.

DESCRIPTION OF THE PREFERRED EMBODIMENT

Figure 1:
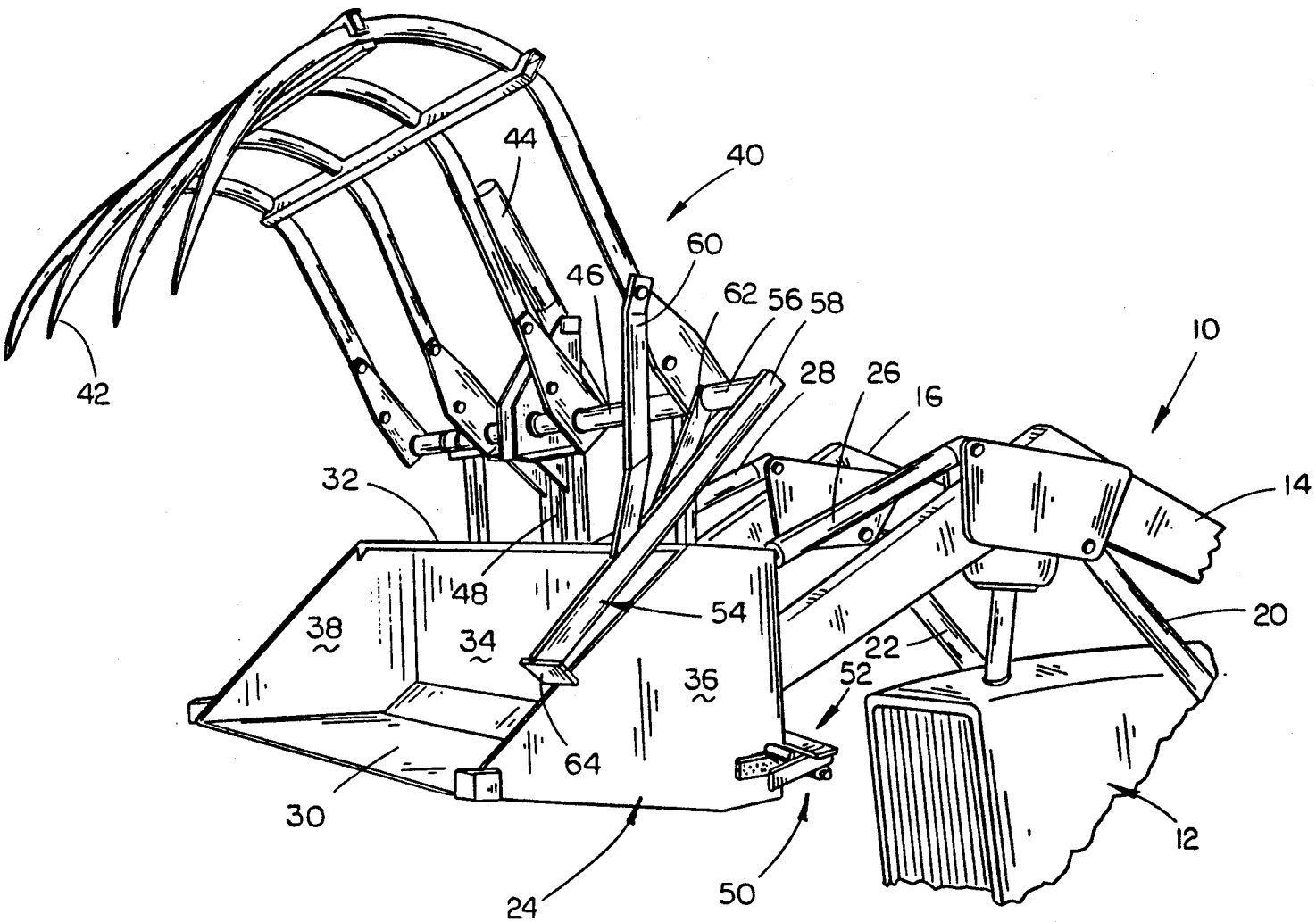
FIG. 1 is a front perspective view of the post puller of this invention mounted on a tractor loader.

In the drawings, the numeral 10 refers to a conventional tractor loader or front-end loader as they are sometimes called. Loader 10 is mounted on a conventional tractor 12 having the conventional hydraulic system, controls, etc. Loader 10 includes a pair of boom arms or loader arms 14 and 16 which are pivotally connected at their rearward ends to the loader frame 18. Hydraulic cylinders 20 and 22 are provided between the loader frame 1B and the arms 14 and 16 to raise and lower the arms 14 and 16 in conventional fashion. A conventional loader bucket 24 is pivotally mounted, about a horizontal axis, to the forward ends of arms 14 and 16 in conventional fashion. A pair of hydraulic cylinders 26 and 28 interconnect the arms 14 and 16 and the rearward end of the loader bucket 24 to pivotally move the bucket 24, about a horizontal axis, relative to the forward ends of the arms 14 and 16. For purposes of description, loader bucket 24 will be described as including a bottom wall 30, upper wall 32, back wall 34, and opposite side walls 36 and 38.

Figure 3:
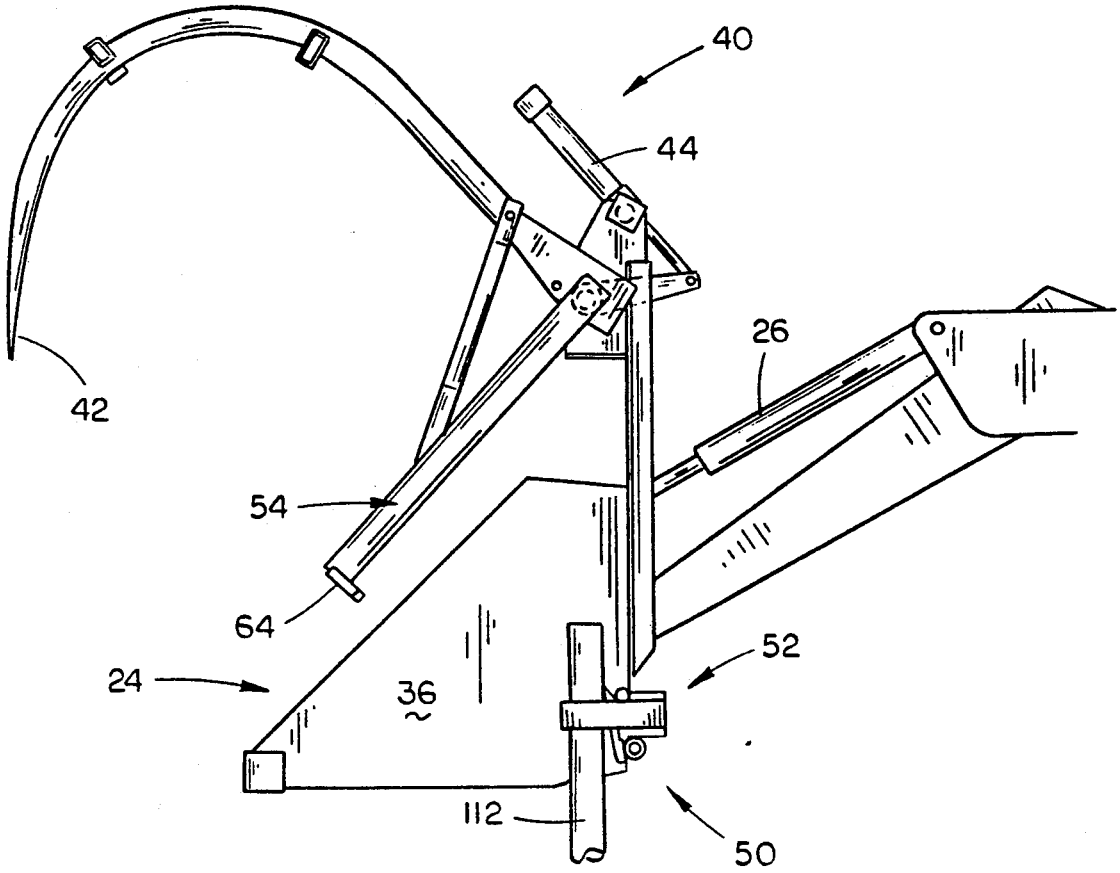
FIG. 3 is a side view of the post puller which illustrates a post having by the post receiving portion of the invention and prior to any clamping action.
Figure 4:
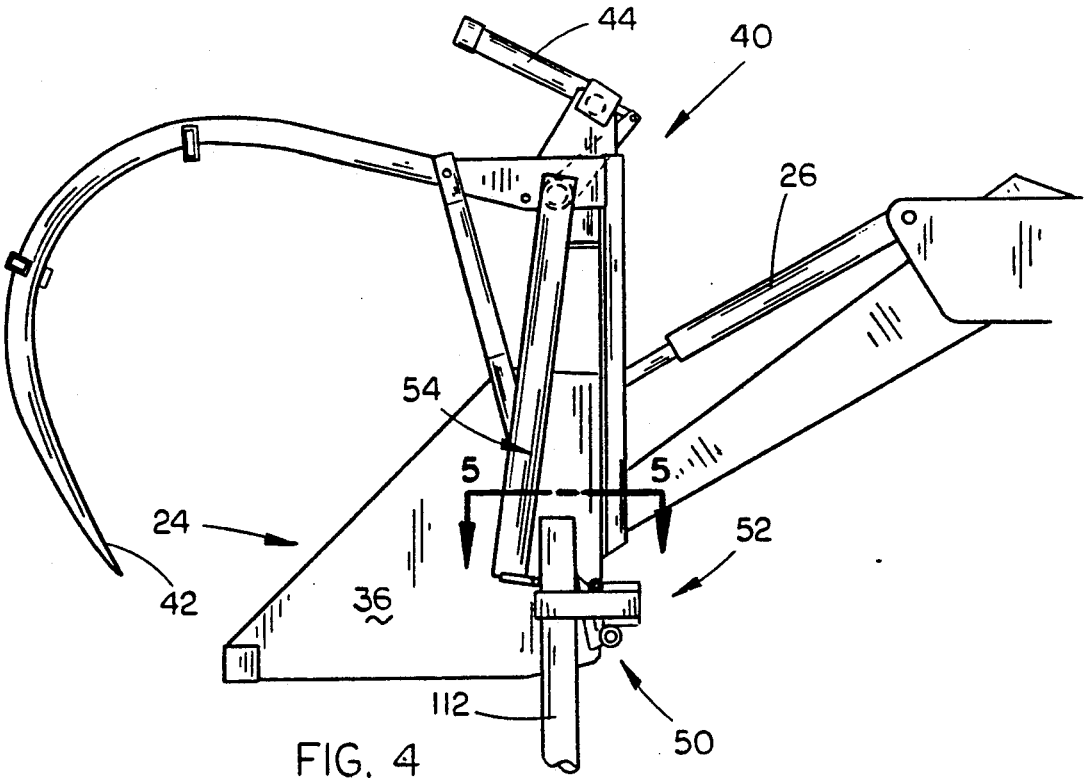
FIG. 4 is a view similar to FIG. 3 except that the post has been clamped into the post puller.

The numeral 40 refers to a conventional grapple fork attachment which is mounted on the bucket 24 and which is pivotally mounted, about a horizontal axis, to the bucket 24, so that the grapple fork 40 may be pivotally moved between the positions of FIGS. 3 and 4. It should be noted that FIG. 4 does not illustrate the grapple fork in its lowermost position. Conventionally, the lower ends of the forks 42 would be positioned closely adjacent the forward end of bottom wall 30 when the fork 40 is in its lowermost condition. A hydraulic cylinder 44 is provided on the grapple fork 40 for pivotally moving the grapple fork 40 from its upper (open) position to its lower (closed) position.

As seen in the drawings, grapple fork 40 includes a horizontally disposed shaft or pipe 46 which is pivotally or rotatably mounted on a frame 48 attached to the rearward side of the bucket 24. Shaft or pipe 46 is rotated relative to the frame 48 when the cylinder 44 is actuated.

The numeral 50 refers generally to the post puller of this invention and essentially comprises a post receiving portion or means 52, in the form of a jaw means, and a clamping arm portion 54. Clamping arm 54 portion includes a shaft 56 which is secured to the outer end of shaft 46 for rotation therewith. Arm 58 is secured, by welding or the like, to the outer end of shaft 56 and extends transversely therefrom. Braces 60 and 62 are provided for strengthening purposes. The lower end of arm 58 has a plate or bar 64 secured thereto as seen in FIG. 1. Plate 64 is provided with an irregular gripping surface 66 in the form of teeth or the like to aid in gripping the post to be pulled. It should be noted that plate 64 is positioned so as to pass over the upper end of the post receiving portion 52 so that the post puller will not interfere with the normal operation of the grapple hook 40.

Figure 2:
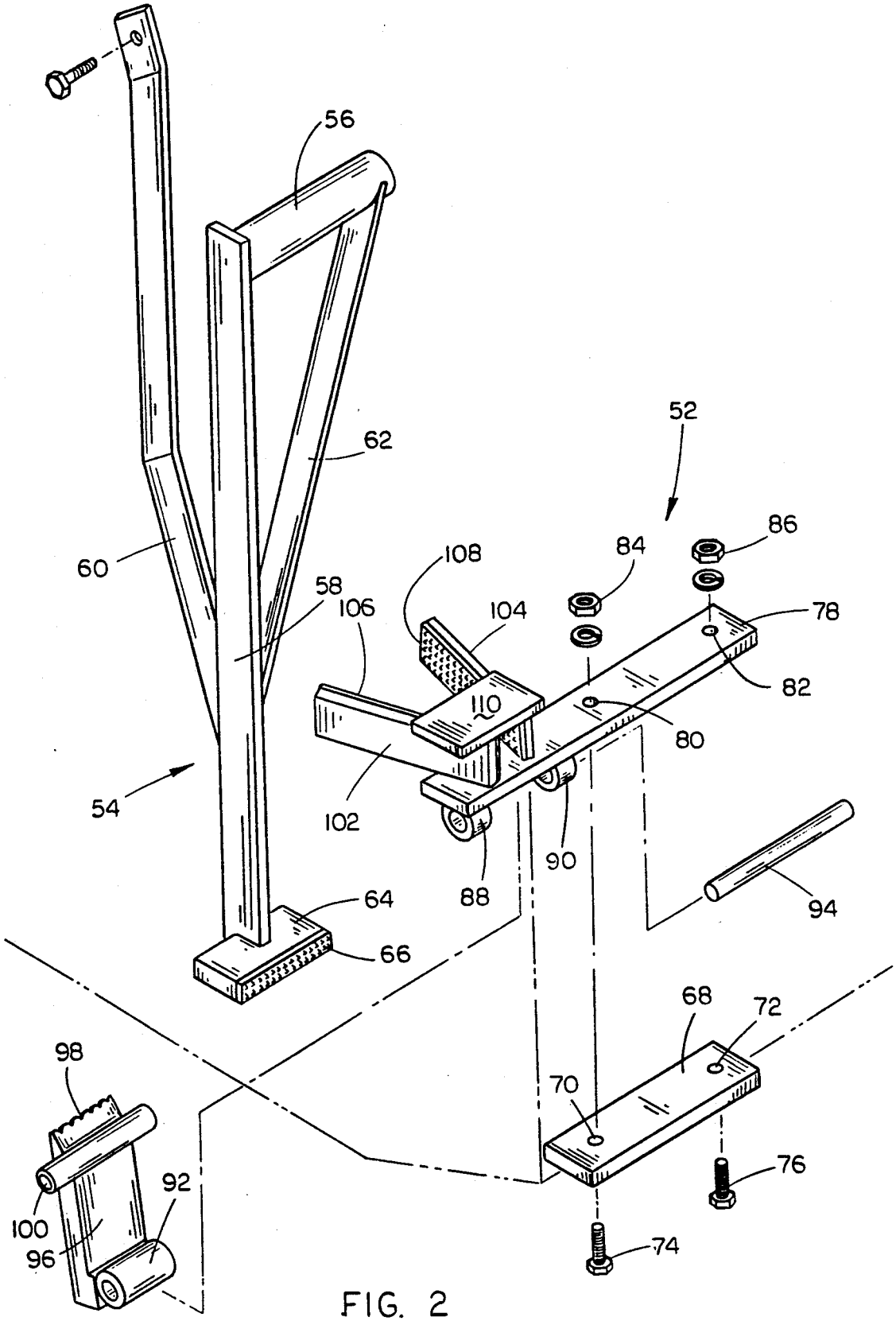
FIG. 2 is an exploded perspective view of the post puller of this invention.

Post receiving portion 52 includes a horizontally disposed bar 68 which is welded to the outer surface of back wall 34 adjacent side wall 36. Bar 68 has a pair of openings 70 and 72 formed therein adapted to receive bolts 74 and 76 respectively. Bar 78 is removably connected to the bar 68 by means of the bolts 74 and 76 extending through openings 80 and 82 respectively and being secured by means of nuts 84 and 86. A pair of spaced-apart collars 88 and 90 are welded to the underside of bar 78 adjacent the outer end thereof and which are adapted to receive the sleeve 92 therebetween. Sleeve 92 is pivotally positioned relative to collars 88 and 90 by means of the pivot pin 94 extending through collar 90, sleeve 92 and collar 88. Sleeve 92 is secured to the lower rearward side of gripping finger 96 which extends upwardly and forwardly therefrom. The upper end of finger 96 is provided with an irregular gripping surface 98 provided thereon as illustrated in FIG. 2. Stop pin or shaft 100 is secured to the upper rearward side of finger 96 for a purpose to be described hereinafter.

A pair of jaw members 102 and 104 are welded to the upper surface of bar 78 adjacent the outer end thereof and extend forwardly therefrom in a diverging fashion to essentially define a V-shape. Jaw members 102 and 104 are provided with irregular gripping surfaces 106 and 108 on the inner surfaces thereof for gripping the post to be pulled. Plate 110 is secured to and extends between the upper rearward ends of jaw members 102 and 104 as seen in FIG. 2. Finger 96 extends upwardly and forwardly between jaw members 102 and 104 near the rearward end thereof so that its upper end is disposed above the jaw members 102 and 104. Stop pin 100 is positioned above jaw members 102 and 104 and is adapted to engage the same to limit the forward pivotal movement of the finger 96 when a post is not received between the jaw members 102 and 104.

In operation, the tractor and loader may be used in a conventional manner without the add-on post puller interfering with any operation thereof. When it is desired to pull a wood post 112 from the ground, grapple fork 40 is pivotally moved to its upper or open position by the hydraulic cylinder 44 so that the arm 58 is pivotally moved upwardly and forwardly from the post receiving portion 52. The tractor is driven so that the post 112 is received between the V-shaped jaw members 102 and 104. The V-shape of the jaw members not only assists in wedging the post therebetween, but also enables the jaw members to receive wood posts having various diameters.

Figure 10:
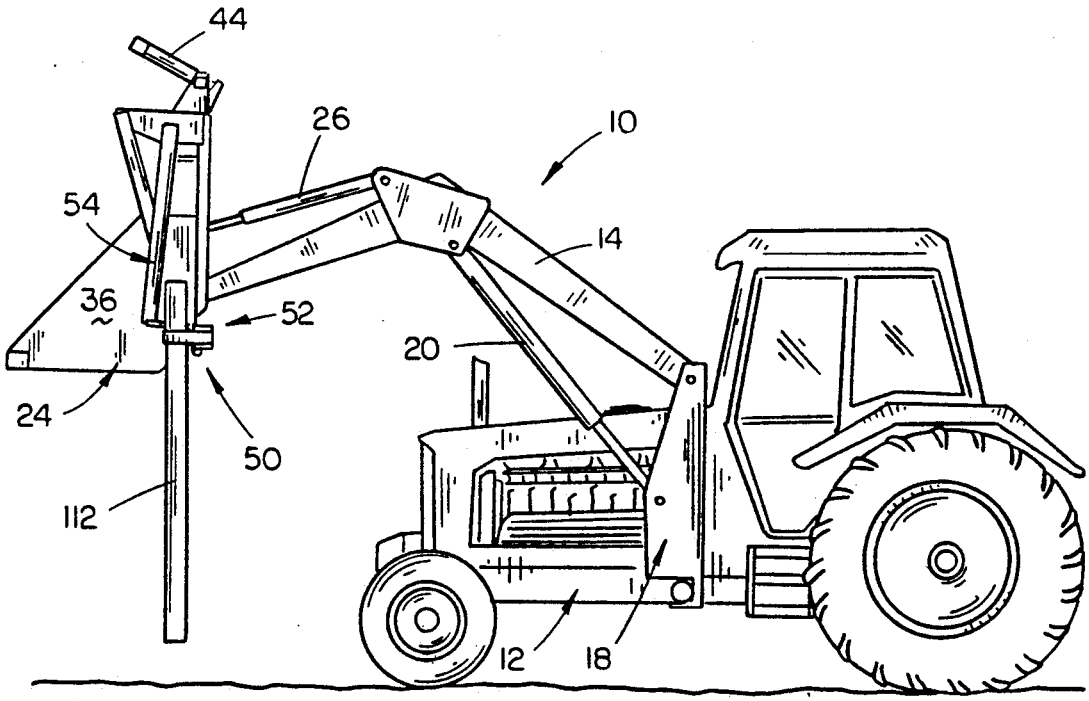
FIG. 10 is a view similar to FIG. 9 except that the post has been removed from the ground through the raising of the loader bucket.

When the post 112 has been positioned between the jaw members 102 and 104, hydraulic cylinder 44 is actuated to cause the grapple fork to pivot from its upper or open position of FIG. 3 to the position of FIG. 4. The lowering of the grapple fork by the hydraulic cylinder 44 causes the rearward end of bar 64 to engage the post 112 to wedge or clamp the post between bar 64 and the jaw members 102 and 104. The clamping of the post 112 between the jaws 102 and 104 by the bar 64 causes the finger 96 to pivot upwardly and rearwardly. The loader arms 14 and 16 are then raised by the hydraulic cylinders 20 and 22 which causes the post to be pulled from the ground as illustrated in FIG. 10. As the loader bucket moves upwardly, the upper end of the finger 96 tends to bite or dig into the post to further clamp the post in position.

Figure 7:
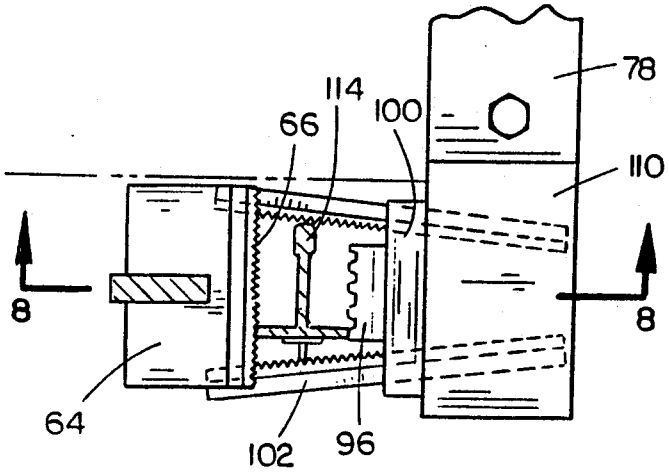
FIG. 7 is a view similar to FIG. 5 except that a steel post has been received between the jaws rather than a wooden post.
Figure 8:
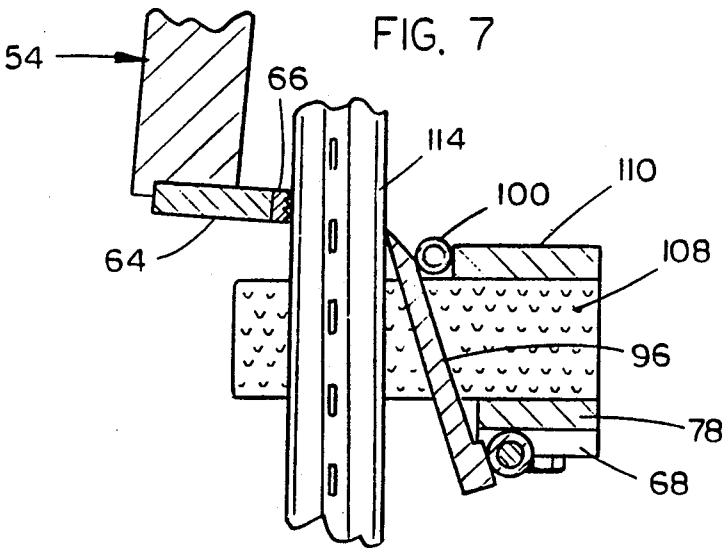
FIG. 8 is a sectional view seen on lines 8—8 of FIG. 7.
Figure 5:
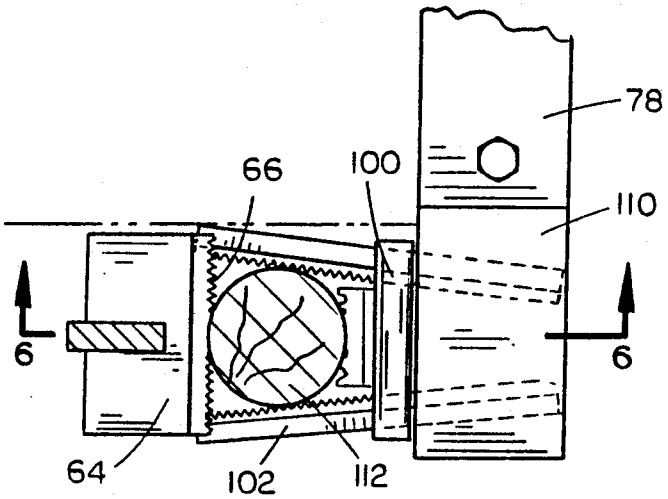
FIG. 5 is an enlarged sectional view as seen in lines 5—5 of FIG. 4.
Figure 6:
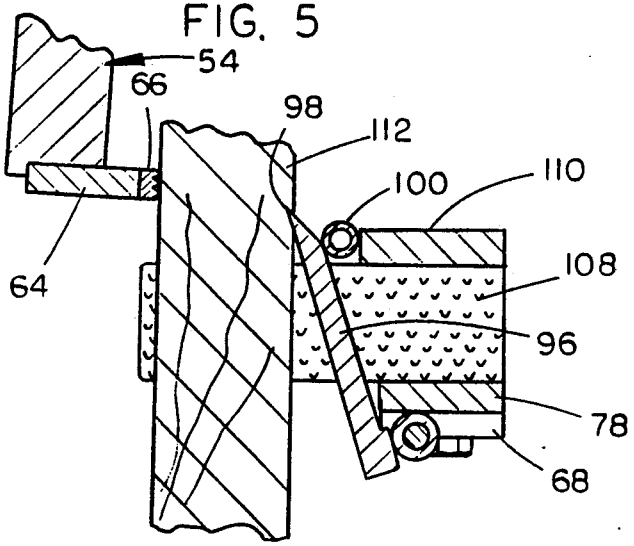
FIG. 6 is a sectional view seen on lines 6—6 of FIG. 5.
Figure 9:
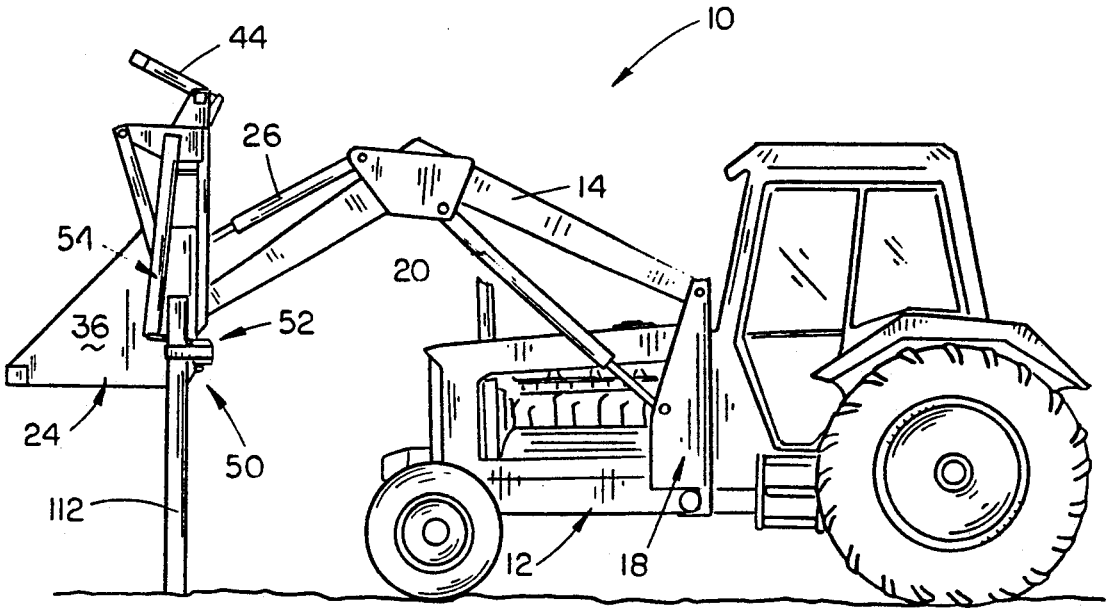
FIG. 9 is a side view illustrating the post puller connected to a post.

The post puller of this invention is also adapted to accommodate steel posts such as illustrated in FIGS. 7 and 8. The steel post 114 is received between the jaw members 102 and 104 as illustrated in FIG. 7 with a portion of the post 114 being brought into engagement with the finger 96. The bar 64 wedges the post 114 between bar 64, the jaw members 102, 104 and the finger 96 so that the post is securely clamped or locked into position in the post puller. The bucket 24 is raised as previously described to pull the post from the ground.

Thus it can be seen that a novel add-on post puller has been provided which may be added to a conventional tractor loader so that the tractor loader may be used to pull posts whether the posts be wood, steel, etc. The position of the post puller on the bucket is such that the tractor operator may conveniently view the same and may successively pull posts without leaving the tractor. Although the post puller is ideally suited for use on a loader bucket having a grapple fork pivotally mounted thereon, the clamping arm 54 could be pivotally secured to other attachments or other structure on the tractor loader bucket even if a grapple fork were not being used. For example, the arm 54 could be pivotally secured to other mounting structure on the bucket with a separate hydraulic cylinder being used to manipulate the same. However, such a modification would result in the need for an additional mounting structure, hydraulic cylinder, etc.

Thus it can be seen that the post puller of this invention accomplishes at least all of its stated objectives.

I claim:

1. In combination, a tractor having a forward end and a rearward end, a front loader mounted on said tractor, said front loader including a loader frame means, a pair of boom arms pivotally mounted to said loader frame means and extending forwardly therefrom, each of said boom arms having a forward end, a first hydraulic cylinder means for pivotally moving said boom arms with respect to said loader frame means so that the forward ends of said boom arms may be selectively raised or lowered, a loader bucket pivotally mounted, about a horizontal axis, on the forward ends of boom arms and having upper and lower ends, and opposite sides, a second hydraulic cylinder means for pivotally moving said loader bucket means with respect to said boom arms, a grapple fork means pivotally mounted, about a horizontal axis, at the upper end of said loader bucket means and being movable from a first upper position to a second lower position relative to said loader bucket means, a third hydraulic cylinder means for pivoting said grapple fork means relative to said loader bucket means, and a post puller means for pulling upstanding posts from the ground, said post puller means comprising a post receiving means mounted at one side of said loader bucket means which has a forwardly presented opening adapted to receive the post to be pulled therein, and an arm means operatively connected to said grapple fork means for movement therewith, said arm means extending from said grapple fork means so that said arm means will be spaced forwardly of said post receiving means when said grapple fork means is in its first upper position and so that said arm means will be closely positioned adjacent the said post receiving means, when said grapple fork means is moved to its said second lower position, to clamp the post to be pulled into said post receiving means, the upward movement of said loader bucket means, after the post has been clamped into said post receiving means, causing the post to be pulled from the ground.

2. The combination of claim 1 wherein said post receiving means includes a V-shaped jaw means.

3. The combination of claim 2 wherein said jaw means comprises first and second jaw member having inner and outer surfaces, and wherein said inner surfaces of said jaw members have post gripping surfaces provided thereon.

4. The combination of claim 1 wherein said arm means includes an upper end which is secured to said grapple fork means and a lower end which is positioned closely above said post receiving means when said grapple fork means has been moved to its said second lower position.

5. The combination of claim 4 wherein the lower end of said arm means has a rear end which has a gripping surface provided thereon.

6. The combination of claim 3 wherein said jaw members are horizontally spaced and have rearward and forward ends, an upstanding finger means having upper and lower ends, the lower end of said finger means being positioned between said jaw members at the rearward ends thereof and being pivoted, about a horizontal axis, with respect to said jaw members, the upper end of said finger means engaging the post to be pulled, when the post is clamped into said jaw members, to aid in clamping the post into the post receiving means.

7. In combination with a tractor having a forward end and a rearward end, a front loader mounted on said tractor, said front loader including a loader frame means, a pair of boom arms pivotally mounted to said frame means and extending forwardly therefrom, each of said boom arms having a forward end, a first hydraulic cylinder means for pivotally moving said boom arms with respect to said loader frame means so that the forward ends of said boom arms may be selectively raised or lowered, a loader bucket pivotally mounted, about a horizontal axis, on the forward ends of boom arms and having upper and lower ends, and opposite sides, a second hydraulic cylinder means for pivotally moving said loader bucket means with respect to said boom arms, a grapple fork means pivotally mounted, about a horizontal axis, at the upper end of said loader bucket means and being movable from a first upper position to a second lower position relative to said loader bucket means, a third hydraulic cylinder means for pivoting said grapple fork means relative to said loader bucket means, comprising, a post puller means for pulling upstanding posts from the ground, said post puller means comprising a post receiving means mounted at one side of said loader bucket means having a forwardly presented opening adapted to receive the post to be pulled therein, and an arm means operatively connected to said grapple fork means for movement therewith, said arm means extending from said grapple fork means so that said arm means will be spaced forwardly of said post receiving means when said grapple fork means is in its first upper position and so that said arm means will be closely positioned adjacent the said post receiving means, when said grapple fork means is moved to its said second lower position, to clamp the post to be pulled into said post receiving means, the upward movement of said loader bucket means, after the post has been clamped into said post receiving means, causing the post to be pulled from the ground.

8. The combination of claim 7 wherein said post receiving means includes a V-shaped jaw means.

9. The combination of claim 8 wherein said jaw means comprises first and second jaw members having inner and outer surfaces, and wherein said inner surfaces of said jaw members have post gripping surfaces provided thereon.

10. The combination of claim 7 wherein said arm means includes an upper end which is secured to said grapple fork means and a lower end which is positioned closely above said post receiving means when said grapple fork means has been moved to its said second lower position.

11. The combination of claim 10 wherein the lower end of said arm means has a rear end which has a gripping surface provided thereon.

12. The combination of claim 9 wherein said jaw members are horizontally spaced and have rearward and forward ends, an upstanding finger means having upper and lower ends, the lower end of said finger means being positioned between said jaw members at the rearward ends thereof and being pivoted, about a horizontal axis, with respect to said jaw members, the upper end of said finger means engaging the post to be pulled, when the post is clamped into said jaw members, to aid in clamping the post into the post receiving means.

13. In combination, a tractor having a forward end and a rearward end, a front loader mounted on said tractor, said front loader including a loader frame means, a pair of boom arms pivotally mounted to said frame means and extending forwardly therefrom, each of said boom arms having a forward end, a first hydraulic cylinder means for pivotally moving said boom arms with respect to said loader frame means so that the forward ends of said boom arms may be selectively raised or lowered, a loader bucket pivotally mounted, about a horizontal axis, on the forward ends of boom arms and having upper and lower ends, and opposite sides, a second hydraulic cylinder means for pivotally moving said loader bucket means with respect to said boom arms, first means pivotally mounted, about a horizontal axis, at the upper end of said loader bucket means and being movable from a first upper position to a second lower position relative to said loader bucket means, a third hydraulic cylinder means for pivoting said first means relative to said loader bucket means, and a post puller means for pulling upstanding posts from the ground, said post puller means comprising a post receiving means mounted at one side of said loader bucket means having a forwardly presented opening adapted to receive the post to be pulled therein, and an arm means operatively connected to said first means for movement therewith, said arm means extending from said first means so that said arm means will be spaced forwardly of said post receiving means when said first means is in its first upper position and so that said arm means will be closely positioned adjacent the said post receiving means, when said first means is moved to its said second lower position, to clamp the post to be pulled into said post receiving means, the upward movement of said loader bucket means, after the post has been clamped into said post receiving means, causing he post to be pulled from the ground.

14. The combination of claim 13 wherein said first means comprises a materials handling apparatus.

* * * * *